United States Patent [19]

Krakauer

[11] Patent Number: 4,699,362

[45] Date of Patent: Oct. 13, 1987

[54] SPRING ELEMENT

[75] Inventor: Edwin G. Krakauer, Roslyn Heights, N.Y.

[73] Assignee: Leggett & Platt, Incorporated, Carthage, Mo.

[21] Appl. No.: 6,889

[22] Filed: Jan. 27, 1987

Related U.S. Application Data

[63] Continuation of Ser. No. 752,282, Jul. 5, 1985, abandoned.

[51] Int. Cl.[4] ..... B21F 27/00; F16F 3/04

[52] U.S. Cl. ..... 267/91; 5/248; 5/256; 5/267; 140/3 CA

[58] Field of Search ..... 267/80, 91, 95, 100, 267/101, 103, 106, 110, 166, 179, 61 R; 5/248, 256, 257, 260, 271-273, 276, 267, 478; 140/3 CA, 103

[56] References Cited

U.S. PATENT DOCUMENTS

| | | | |
|---|---|---|---|
| 664,756 | 12/1900 | Hunt | 5/267 |
| 1,089,233 | 3/1914 | Leggett | 5/267 |
| 3,660,854 | 5/1972 | Garceau | 5/267 |
| 3,766,578 | 10/1973 | Toupal | 5/267 |
| 3,777,322 | 12/1973 | Larkin | 5/267 |
| 3,833,949 | 9/1974 | Piliero | 5/267 X |
| 3,864,765 | 2/1975 | Anonauer | 5/267 X |
| 3,874,423 | 4/1975 | Larkin | 140/3 CA |
| 3,953,903 | 5/1976 | Lawrence et al. | 5/267 |
| 3,958,610 | 5/1976 | Garceau | 140/3 CA |
| 4,004,304 | 1/1977 | Kane | 5/267 |
| 4,068,330 | 1/1978 | Rakow et al. | 5/267 |
| 4,160,544 | 7/1979 | Higgins | 267/166 |
| 4,236,262 | 12/1980 | Spiller | 5/267 |
| 4,426,070 | 1/1984 | Garceau et al. | 267/91 |

FOREIGN PATENT DOCUMENTS 2526292 11/1983 France .

*Primary Examiner*—Douglas C. Butler
*Attorney, Agent, or Firm*—Wood, Herron & Evans

[57] ABSTRACT

A spring element for bedding and furniture which can be constructed in a simple manner but will not tend to come apart in ordinary use. The spring element includes a laterally extending pair of parallel wires and a longitudinally extending pair of parallel wires atop the laterally extending wires. The pairs of wires are welded to one another at their crossing points to form a seat for engaging the open top loop of a coil spring, and the ends of the wires are connected to a framework. Each longitudinally extending wire has a depressed portion between the crossing points extending beneath the laterally extending wires. The top loop of the spring is snapped into engagement with the pairs of wires, so that the top loop is sealed above the depressed portions of the longitudinally extending wires and beneath the laterally extending wires and so that the top of the free end portions of the top loop is biased against the bottom of one of the laterally extending wires.

8 Claims, 6 Drawing Figures

SPRING ELEMENT

This is a continuation of application Ser. No. 752,282, filed Jul. 5, 1985, now abandoned.

BACKGROUND OF THE INVENTION

This invention relates to a spring element which can be used in a box spring for bedding and for upholstered furniture. This invention also relates to a method for connecting coil springs within a bedding or furniture framework by engaging the top loops of the spring with pairs of parallel wires that are connected to the framework and form a grid within the framework.

Spring elements formed by engaging the top loops of coil springs with grids formed by pairs of parallel wires within bedding and furniture frameworks are well known. See, for example, U.S. Pat. Nos. 664,756, 3,777,322, 3,833,949, 3,864,765 and 4,004,304. However, it has generally been difficult to form such spring elements so that the top loops of the springs are securely engaged by the grids of parallel wires and cannot come apart in ordinary use. There has been a need, therefore, for a spring element which is easier to construct but will not have a tendency to come apart in use.

SUMMARY OF THE INVENTION

In accordance with this invention, a spring element is provided which can be constructed in a simple manner but will not tend to come apart in ordinary use. The spring element comprises:

- a coil spring having an open top loop with free end portions;
- a first pair of substantially horizontal, longitudinally extending, parallel wires; and
- a second pair of substantially horizontal, laterally extending, parallel wires which cross the first pair of wires at substantially a right angle; the first and second pairs of wires being bonded to one another at their crossing points to form an opening defining a substantially horizontal seat for engaging the top loop of the spring;
- the top loop of the spring being seated above one pair of wires and beneath the other pair of wires; and the top of the free end portions of the top loop being biased against the bottom of one of the wires above the top loop between the two crossing points of the one wire forming the seat.

DETAILED DESCRIPTION OF THE PREFERRED EMBODIMENTS

Figure 1:
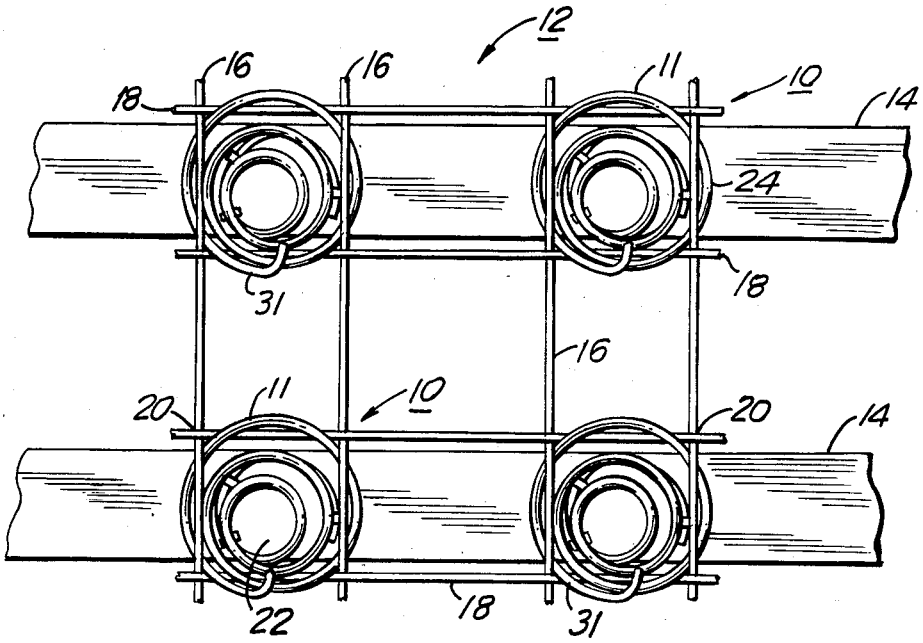
FIG. 1 is a top plan schematic view of a bedding framework in which are provided a plurality of the spring elements of one embodiment of this invention.
Figure 2:
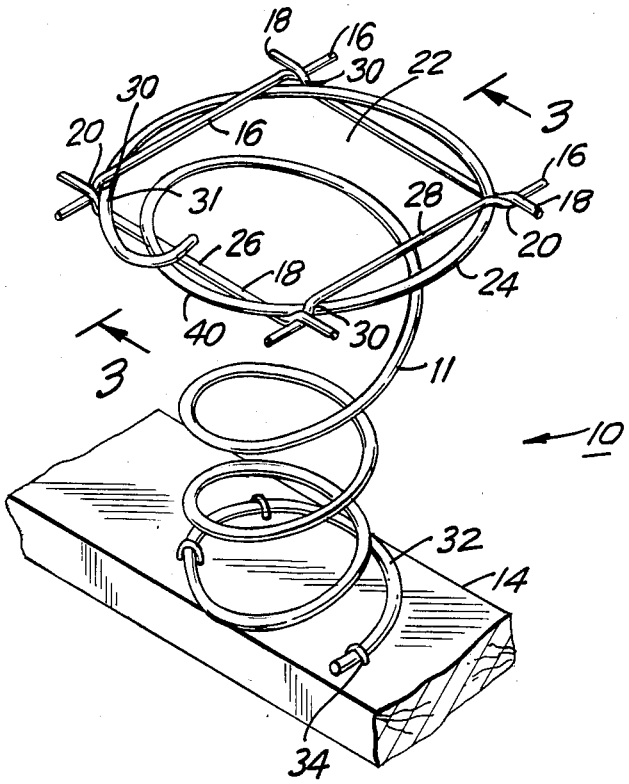
FIG. 2 is a perspective view of one of the spring elements in FIG. 1.
Figure 3:
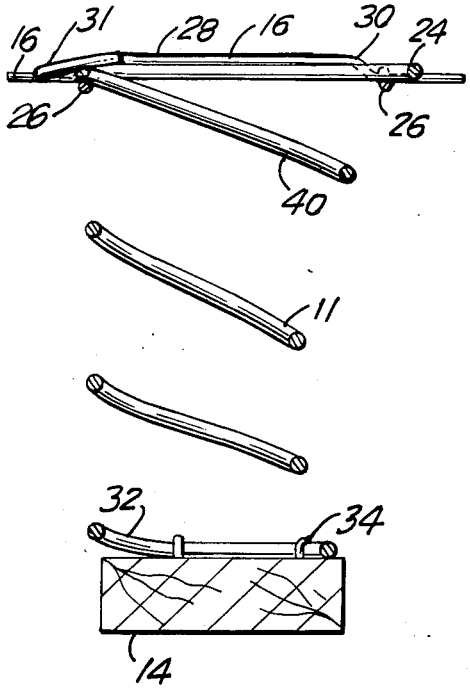
FIG. 3 is a section view taken along line 3—3 in FIG. 2.

Shown in FIGS. 1–3 is one embodiment of a spring element of this invention, generally 10, formed by a coil spring 11, such as a conventional helical compression coil spring, with its axis vertically aligned.

As shown in FIG. 1, a plurality of the spring elements 10 of this invention are provided in a conventional generally rectangular, bedding framework, generally 12, such as a box spring. At the bottom of the framework 12 are a plurality of laterally extending wooden slats 14, and at the top of the framework 12 are a plurality of spaced pairs of longitudinally extending, parallel elongated metallic, preferably steel, rods or wires 16 and a plurality of spaced pairs of laterally extending, parallel elongated metallic wires 18. The slats 14 and wires 16 and 18 are secured in a conventional manner to the framework 12, e.g., at spaced points along longitudinally and laterally extending frame members (not shown) of the framework 12. As secured within the framework 12, the wires 16 and 18 are substantially horizontal and coplanar, and at the points 20 where they cross, the laterally extending wires 18 lie above the longitudinally extending wires 16. At their crossing points 20, the laterally extending wires 18 and the longitudinally extending wires 16 are bonded, preferably welded, to one another to form a permanent, substantially horizontal, grid-like array with a plurality of substantially square openings 22. Each opening 22 in the grid of wires 16 and 18 is surrounded by a pair of longitudinally extending wires 16 and by a pair of laterally extending wires 18, and each opening 22 comprises a substantially horizontal seat for the open top loop 24 of the coil spring 11 of one of the spring elements 10 as described below. The lateral distance between the wires 16 of each pair of longitudinally extending wires 16 and the longitudinal distance between the wires 18 of each pair of laterally extending wires 18 are each substantially less than the diameter of the top loop 24 of each coil spring 11. Thereby, the top loop 24 of the coil spring 11 of each spring element 10 extends longitudinally and laterally outwardly of the four sides of the opening 22 in which the top loop 24 is seated.

About each opening 22 in the grid of wires 16 and 18 as shown in FIGS. 2 and 3, the laterally extending pair of wires 18 have depressed portions 26 between the crossing points 20 which extend beneath the longitudinally extending pair of wires 16 at the crossing points 20. About each opening 22, as shown in FIGS. 2 and 3, the longitudinally extending pair of wires 16 have elevated portions 28 between the crossing points 20, and the elevated portions 28 extend above the laterally extending pair of wires 18 at the crossing points 20. Preferably, each elevated and depressed wire portion 28 and 26 extends substantially the entire distance along its wire 16 or 18 between two crossing points 20 about its opening 22, and the ends 30 of each depressed and elevated wire portion 26 and 28 are closely spaced about the top loop 24 of the coil spring 11 seated in its opening 22 to hold the top loop 24 horizontally in place between the crossing points 20. The vertical distance between the depressed and elevated wire portions 26 and 28 is preferably at least equal to about the thickness of the top loop 24 of each of the coil springs 11, and it is particularly preferred that the vertical distance between the depressed and elevated wire portions 26 and 28 substantially equal the thickness of the top loop 24 of each coil spring 11 so that the wire portions 26 and 28 hold the top loop 24 vertically in place between them at each opening 22.

The open top loop 24 of the coil spring 11 of each spring element 10 can be snapped into engagement with the seat formed by one of the square openings 22 in the gridlike array of wires 16 and 18, so that as shown in FIGS. 1–3: a) the top loop 24 is located above the depressed portions 26 of the laterally extending pair of wires 18 about its opening 22 and beneath the elevated portions 28 of the longitudinally extending pair of wires 16 about its opening 22; and b) the top of the free end portions 31 of the top loop 24 is biased against the bottom of the elevated portion 28 of one of the longitudinally extending wires 16 between the two crossing points 20 of the wire 16 about its opening 22, preferably at one end 30 of that elevated portion 28. This snap-in engagement of the top loop 24 of each spring 11 about its opening 22 can be accomplished, for example, by: (a) squeezing diametrically opposite sides of the open top loop 24 to deform the top loop so that it can be inserted upwardly through its opening 22 above the depressed portions 26 of the laterally extending wires 18; and (b) then allowing the top loop to spring back over the depressed portions 26 of the laterally extending wires 18. The snap-in engagement of the top loop 24 of each spring 11 with the seat formed by its opening 22 in the grid of wires 16 and 18 is effective to hold the top loop 24 and its free end portions 31 securely in place within the bedding framework 12 so that the top loop will not become separated from the seat formed by the opening 22 in ordinary use of bedding made with the spring elements 10. Preferably, this snap-in engagement of the top loop 24 causes the bottom of its free end portions 31 to be located adjacent to, and preferably biased against, the top of the loop 40 of its spring 11 located directly beneath the top loop. This provides the spring elements 10 with increased vertical force resistance along the entire length of the top loop 24 of its spring 11, particularly adjacent the free end portions 31 of the top loop.

As also shown in FIGS. 2 and 3, the bottom loop 32 of each coil spring 11 is preferably secured, for example with staples 34, to one of the slats 14. Each spring 11 is preferably secured to a slat 14 vertically beneath the square opening 22 which defines the seat for its top loop 24 in the grid of wires 16 and 18.

Figure 4:
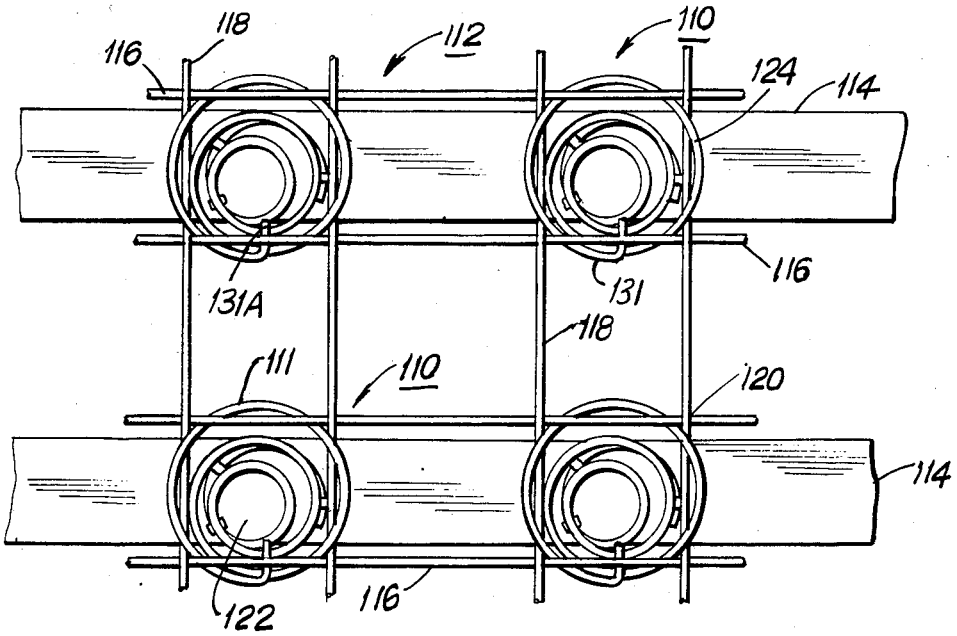
FIG. 4 is a top plan schematic view of a bedding framework provided with a plurality of the spring elements of an alternative embodiment of this invention.
Figure 5:
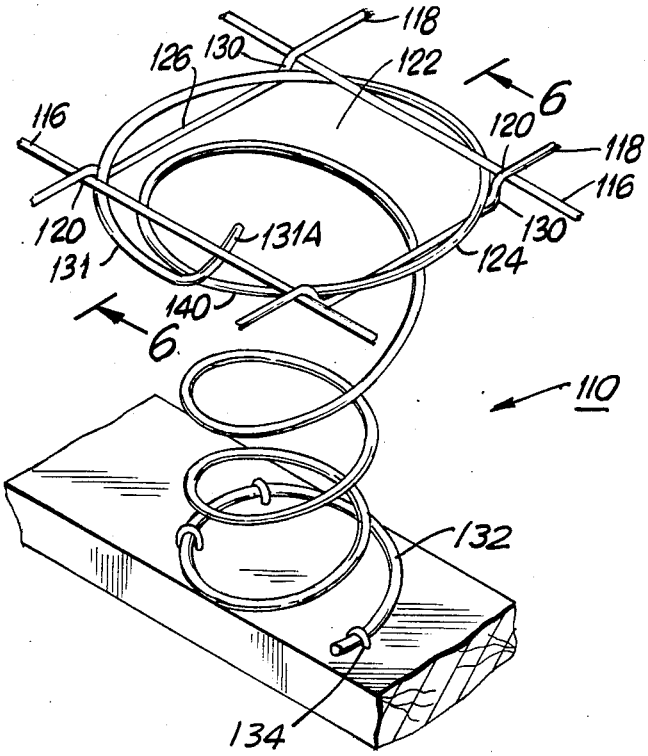
FIG. 5 is a perspective view of one of the spring elements in FIG. 4.
Figure 6:
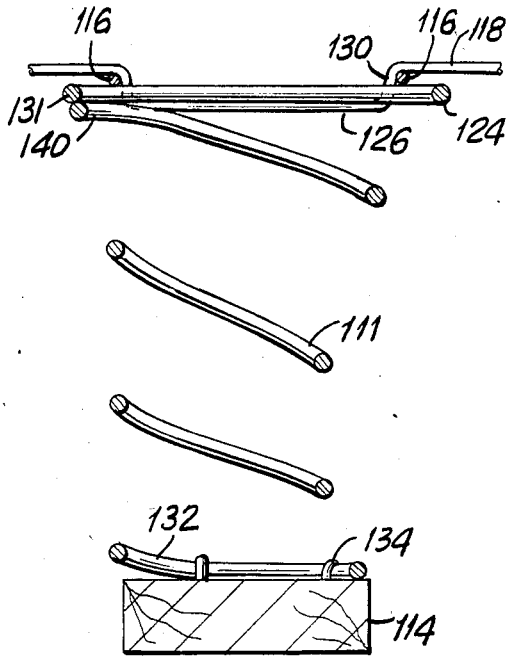
FIG. 6 is a section view taken along line 6—6 in FIG. 5.

Shown in FIGS. 4–6 is an alternative embodiment of a spring element of this invention, generally 110. Parts of the spring element 110 corresponding to the parts of the spring element 10 of FIGS. 1–3 have reference numerals which differ by 100 from the corresponding parts of the spring element 10. Each spring element 110 of FIGS. 4–6 is formed by a coil spring 111 having its bottom loop 132 secured to one of the slats 114 of the bedding framework 112 and its open top loop 124 secured, as described below, to longitudinally extending pairs of wires 116 and laterally extending pairs of wires 118 which are secured to the framework 112. At their crossing points 120, the laterally extending wires 118 overlie, and are bonded to, the longitudinally extending wires 116 to form a permanent, substantially horizontal, grid-like array with a plurality of substantially sqaure openings 122. Each opening 122 comprises a substantially horizontal seat for the open top loop 124 of the coil spring 111 of one of the spring elements 110 within the bedding framework 112 shown in FIG. 4, and the top loop 124 of each spring 111 extends longitudinally and laterally outwardly of the four sides of the opening 122 in which it is seated.

About each opening 122 as shown in FIGS. 5 and 6, the laterally extending pair of wires 118 have depressed portions 126 between the crossing points 120 which extend beneath the longitudinally extending pair of wires 116 at the crossing points 120, and the longitudinally extending pair of wires 116 are substantially straight between the crossing points. Preferably, the vertical distance between the depressed wire portions 126 of the laterally extending pair of wires 118 and the longitudinally extending pair of wires 116 is substantially equal to the thickness of the top loop 124 of each coil spring 111 so that the pairs of wires 116 and 118 hold the top loop 124 vertically in place between them about each opening 122. It is also preferred that the depressed portion 126 of each of the laterally extending wires 118 extend substantially the entire distance along the wire 118 between the two crossing points 120 about its opening 122 and that the ends 130 of each depressed portion 126 be closely spaced about the top loop 124 of the coil spring 111 seated in its opening 122 to hold the top loop 124 horizontally in place.

The open top loop 124 of the coil spring 111 of each spring element 110 can be snapped into engagement with the seat formed by one of the square openings 122 in the grid-like array of wires 116 and 118, so that as shown in FIGS. 4–6: (a) the top loop 124 is located above the depressed portions 126 of the laterally extending pair of wires 118 about its opening 122 and beneath the longitudinally extending pair of wires 116 about its opening 122; and (b) the top of the free end portions 131 of the top loop 124 is biased against the bottom of one of the longitudinally extending wires 116 between the two crossing points 120 of the wire 116 about its opening 122. This snap-in engagement of the top loop 124 of each spring 111 can be accomplished, for example, by: a) squeezing diametrically opposite sides of the open top loop 124 to deform the top loop so that it can be inserted upwardly through its opening 122 above the depressed portions 126 of the laterally extending wires 118; and b) then allowing the top loop to spring back over the depressed portions 126 of the laterally extending wires 118. Preferably, this snap-in engagement results in the bottom of the free end portions 131 of the top loop 124 being located adjacent to, and preferably biased against, the top of the loop 140 of its spring 111 located just beneath the top loop 124. Preferably, the free end portions 131 of the top loop 124 also extend inwardly of the top loop and, when the top loop is snapped into engagement with the seat formed by its opening 122, its inwardly extending free end portions 131A extend into its opening 122 beneath the same one longitudinally extending wire 116 to help keep the top loop seated about its opening 122.

It is thought that this invention and many of its attendant advantages will be understood from the foregoing description, and it will be apparent that various modifications and changes can be made in the invention without departing from the spirit and scope thereof or sacrificing all of its material advantages, the spring elements 10 and 110 hereinbefore described being merely preferred embodiments. In this regard, terms such as "longitudinally", "laterally", "horizontally", "vertically", "overlying", "underlying", "above", "beneath", "top" and "bottom" are relative terms used to describe the spring elements in FIGS. 1–6 and in the claims which follow.

I claim:

1. A method for assembling a spring assembly which comprises a base, a plurality of unknotted coil springs, and a grid top, said base and said grid top being located in spaced horizontal planes, said grid top being supported from said base by said plurality of coil springs, each of said coil springs having a bottom loop and an unknotted top loop separated by at least one additional loop, said top loop having an inwardly turned free-end portion engageable with a top surface of an adjacent loop of the spring, said grid top comprising a plurality of first pairs of substantially horizontal, longitudinally extending, parallel wires and a plurality of second pairs of substantially horizontal, laterally extending, parallel wires which cross the first pairs of wires at substantially a right angle, the first and second pairs of wires being fixedly secured to one another at their crossing points, said first and second pairs of wires defining a plurality of spring seats between their crossing points, the method comprising the steps of attaching said bottom loop of each of said sprngs to said base, inserting said top loop of each of said springs upwardly through one of said seats while squeezing diametrically opposite sides of said unknotted top loop to lessen the diameter of said top loops, locating said lessened diameter top loop above one of said first pairs of wires and beneath one of said second pairs of wires defining said one seat, and releasing said lessened diameter top loop so as to allow it to spring back over said one of said first pairs of wires and beneath said one of said second pairs of wires defining said one seat to thereby lock said top loop of said spring within said seat with said end portion of said top loop biased against a bottom surface of one of said wires and against said top surface of said adjacent loop.

2. The method of claim 1 which further comprises welding the first and second pairs of wires to one another at said crossing points so as to fixedly secure the wires together.

3. The method of claim 2 which further comprises forming a depressed portion in each wire of said first pairs of wires in each seat, which depressed portion extends beneath the second pairs of wires and the top loops of the springs being seated above the depressed portions of the first pairs of wires and beneath the second pairs of wires.

4. A box spring assembly which comprises a base, a plurality of unknotted coil springs, and a grid top, said base and said grid top being located in spaced horizontal planes, said grid top being supported from said base by said plurality of unknotted coil springs, each of said coil springs having a bottom loop and an unknotted top loop separated by at least one additional loop, said top loop having an inwardly turned free-end portion engageable with a top surface of an adjacent loop of the spring, said grid top comprising a plurality of first pairs of substantially horizontal, longitudinally extending, parallel wires and a plurality of second pairs of substantially horizontal, laterally extending, parallel wires which cross the first pairs of wires at substantially a right angle, the first and second pairs of wires being fixedly secured to one another at their crossing points, said first and second pairs of wires defining a plurality of spring seats between their crossing points, said bottom loop of each of said springs being attached to said base, said top loop of each of said springs being attached and locked to said grid top by inserting said top loop of each of said springs upwardly through one of said seats while squeezing diametrically opposite sides of said unknotted top loop to lessen the diameter of said top loop so as to position said lessened diameter top loop above one of said first pairs of wires and beneath one of said second pairs of wires defining said one seat, releasing said lessened diameter top loop so as to allow it to spring back into a locked position with said grid, each of said top loops in its locked position with said grid having opposed sections located over said one of said first pairs of wires and the opposed sections located beneath said one of said second pairs of wires defining said one seat, and said end portion of each of said top loops being biased by engagement with a bottom surface of one of said wires against said top surface of said adjacent loop.

5. The box spring of claim 4 wherein the first and second pairs of wires are welded to one another at said crossing points so as to fixedly secure the wires together.

6. The box spring of claim 5 wherein there is a depressed portion in each wire of said first pairs of wires in each seat, said depressed portion extending beneath the horizontal plane of said second pairs of wires and the top loops of the springs being seated above said depressed portions of said first pairs of wires and beneath said second pairs of wires.

7. The box spring of claim 6 wherein the first pairs of wires are positioned to overlie the second pairs of wires at said crossing points.

8. A box spring assembly which comprises a base, a plurality of unknotted coil springs, and a grid top, said base and said grid top being located in spaced horizontal planes, said grid top being supported from said base by said plurality of unknotted coil springs, each of said coil springs having a bottom loop and an unknotted top loop separated by at least one additional loop, said top loop having an inwardly turned free-end portion engageable with a top surface of an adjacent loop of the spring, said grid top comprising a plurality of first pairs of substantially horizontal, longitudinally extending, parallel wires and a plurality of second pairs of substantially horizontal, laterally extending, parallel wires which cross the first pairs of wires at substantially a right angle, the first and second pairs of wires being fixedly secured to one another at their crossing points, said first and second pairs of wires defining a plurality of spring seats between their crossing points, said bottom loop of each of said springs being attached to said base, said top loop of each of said springs being seated within one of said spring seats and thereby attached and locked to said grid top, each of said top loops in its locked position with said grid top having opposed sections located over one of said first pairs of wires and other opposed sections located beneath one of said second pairs of wires defining said one seat, said end portion of each of said top loops being biased by engagement with a bottom surface of one of said wires against said top surface of said adjacent loop.

* * * * *